US006227166B1

(12) United States Patent
Mack

(10) Patent No.: US 6,227,166 B1
(45) Date of Patent: May 8, 2001

(54) MECHANICALLY-ENABLED HYDRAULICALLY-ACTUATED ELECTRONICALLY-CONTROLLED FUEL INJECTION SYSTEM

(75) Inventor: David C. Mack, Pontiac, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 09/314,700

(22) Filed: May 19, 1999

Related U.S. Application Data

(63) Continuation of application No. 08/950,349, filed on Oct. 14, 1997.

(51) Int. Cl.[7] ..... F02M 37/04
(52) U.S. Cl. ..... 123/446; 123/501
(58) Field of Search ..... 123/446, 456, 123/500, 501, 458

(56) References Cited

U.S. PATENT DOCUMENTS

| | | |
|---|---|---|
| 3,955,547 | 5/1976 | Aoki et al. . |
| 4,425,893 | 1/1984 | McJones et al. . |
| 4,440,132 | 4/1984 | Terada et al. . |
| 4,674,448 | 6/1987 | Steiger . |
| 4,784,101 | 11/1988 | Iwanaga et al. . |
| 5,176,120 | 1/1993 | Takahashi . |
| 5,213,083 | 5/1993 | Glassey . |
| 5,245,970 | 9/1993 | Iwaszkiewicz et al. . |
| 5,297,523 | 3/1994 | Hafner et al. . |
| 5,357,929 | 10/1994 | McCandless . |
| 5,413,076 | 5/1995 | Koenigswieser et al. . |
| 5,445,129 | 8/1995 | Barnes . |
| 5,447,138 | 9/1995 | Barnes . |
| 5,463,996 | 11/1995 | Maley et al. . |
| 5,622,152 | 4/1997 | Ishida . |
| 5,676,114 | 10/1997 | Tarr et al. . |
| 5,685,272 | 11/1997 | Paul et al. . |
| 5,709,194 | 1/1998 | Moncelle . |
| 5,722,373 | 3/1998 | Paul et al. . |

FOREIGN PATENT DOCUMENTS

| | | |
|---|---|---|
| 2 289 313 | 3/1995 | (GB) . |

*Primary Examiner*—Carl S. Miller
(74) *Attorney, Agent, or Firm*—Liell & McNeil

(57) ABSTRACT

A fuel injection system includes a fuel injector that defines an actuation fluid cavity, a fuel inlet and a nozzle outlet. A source of relatively high pressure actuation fluid is connected to the actuation fluid cavity via an actuation fluid supply passage. A fuel fluid supply passage extends between the fuel inlet and a source of relatively low pressure fuel fluid. A mechanically actuated valve is attached to the actuation fluid supply passage, and is moveable between an open position in which the actuation fluid supply passage is open and a closed position in which the actuation fluid supply passage is closed.

20 Claims, 4 Drawing Sheets

MECHANICALLY-ENABLED HYDRAULICALLY-ACTUATED ELECTRONICALLY-CONTROLLED FUEL INJECTION SYSTEM

RELATION TO A PRIOR APPLICATION

This application is a continuation of application Ser. No. 08/950,349, filed on Oct. 14, 1997 and allowed on Feb. 23, 1999.

TECHNICAL FIELD

The present invention relates generally to hydraulically-actuated fuel injection systems, and more particularly to a hydraulically-actuated electronically-controlled fuel injector whose actuation is mechanically enabled.

BACKGROUND ART

In most fuel injectors, fuel is pressurized within the injector body by a reciprocating plunger. In one class of fuel injection systems, this plunger is driven downward during its pumping stroke by utilizing a relatively high pressure hydraulic actuation fluid. While virtually any available fluid, including fuel fluid, could conceivably be used as the hydraulic medium in such a fuel injector, Caterpillar, Inc. of Peoria, Ill. has encountered considerable success in utilizing engine lubricating oil as the hydraulic medium in hydraulically-actuated fuel injectors. An example of such a hydraulically-actuated electronically-controlled (HEUI) fuel injector is shown for example in U.S. Pat. No. 5,213,083 to Glassey.

In, a typical HEUI fuel injector, the flow of high pressure actuation fluid to an individual injector is controlled by a solenoid actuated control valve attached to each individual injector. Each injection event is initiated when an engine electronic control module commands energization of the solenoid actuated control valve to move it to open an injector's high pressure actuation fluid inlet. As high pressure actuation fluid (oil) flows into the injector, the internal plunger is driven downward to pressurize fuel. When the fuel reaches a valve opening pressure, a needle valve member opens and fuel commences to spray out of the nozzle outlet of the individual injector. Each fuel injection event is ended by de-energizing the solenoid actuated control valve to close the high pressure actuation fluid inlet. This in turn ends the downward pumping stroke of the internal plunger and causes fuel pressure to drop. When the fuel pressure drops below a certain pressure, the needle valve member closes the nozzle outlet, and the injection event is ended. Between injection events, some biasing means, such as a return spring, retracts the plunger for a subsequent injection event.

While these basic HEUI fuel injectors have performed magnificently for many years, engineers are continuously looking for ways to improve the same. It has become well known that particulate and NOx emissions from a diesel engine can be significantly reduced if one has the ability to control an injection rate profile independent of engine operating conditions. For instance, one injection profile will optimize emissions at idle conditions, whereas a completely different injection rate profile will optimize emissions at a high rpm fully loaded condition for a particular diesel engine. Injection rate profiles have generally been divided into four different groups including pilot injection, boot shaped injection, ramp-square injection and square injection. In almost all cases, engineers have discovered that emissions can be significantly improved if each injection event can be ended as abruptly as possible.

In order to improve control over injection rate shaping and hence the ability to reduce undesirable emissions in a diesel engine utilizing a HEUI type fuel injection system, Caterpillar, Inc. introduced the concept of a directly operated needle valve in HEUI type fuel injectors. This concept is disclosed, for example, in U.S. Pat. No. 5,463,996 to Maley et al. In this type of fuel injector, a first solenoid control valve controls the opening and closing of the high pressure actuation fluid inlet and a second solenoid control valve controls the opening and closing of the needle valve member. In this fuel injector, the needle valve member is modified to include a closing hydraulic surface on one end that is exposed to fluid pressure in a needle control chamber. The needle control valve opens the needle control chamber to one of either a source of high pressure fluid or a low pressure passage. The injector is designed such that the needle valve member will not open or will abruptly close whenever the needle control chamber is opened to the source of high pressure fluid. When the needle control chamber is open to the low pressure passage, the needle valve member behaves as a conventional needle check valve. While the innovation of direct control over the needle valve permits a significant improvement in injection rate shaping, the inclusion of two separate solenoid actuated control valves is less than desirable from both a cost and reliability or robustness standpoint.

The present invention is directed to improving upon the hydraulically-actuated electronically-controlled fuel injection systems of the prior art.

DISCLOSURE OF THE INVENTION

In one embodiment of the present invention, a fuel injection system includes a fuel injector that defines an actuation fluid cavity, a fuel inlet and a nozzle outlet. An actuation fluid supply passage connects the actuation fluid cavity to a source of relatively high pressure actuation fluid. A fuel fluid supply passage connects the fuel inlet to a source of relatively low pressure fuel fluid. A mechanically actuated valve is attached to the actuation fluid supply passage and is moveable between an open position in which the actuation fluid supply passage is open, and a closed position in which the actuation fluid supply passage is closed.

In another embodiment, a fuel injector includes an injector body that defines an actuation fluid inlet, an actuation fluid cavity, a needle control chamber, a fuel inlet and a nozzle outlet. A mechanically actuated valve is attached to the injector body and moveable between a first position in which the actuation fluid inlet is open to the actuation fluid cavity and a second position in which the actuation fluid cavity is closed to the actuation fluid inlet. A needle valve member is positioned in the injector body and has a closing hydraulic surface exposed to fluid pressure in the needle control chamber. The needle valve member is moveable between an open position in which the nozzle outlet is open and a closed position in which the nozzle outlet is blocked. A needle control valve is attached to the injector body and moveable between an off position in which the needle control chamber is open to a source of high pressure fluid and an on position in which the needle control chamber is open to a source of low pressure fluid.

In still another embodiment of the present invention, a fuel injector includes an injector body that defines an actuation fluid inlet, an actuation fluid drain, an actuation fluid cavity, a needle control chamber, a fuel inlet and a nozzle outlet. A mechanically actuated valve is attached to the injector body and includes a cam actuated tappet member exposed outside of the injector body and a spool valve member positioned in the injector body. The spool valve member is moveable between a first position in which the actuation fluid cavity is open to the actuation fluid inlet but closed to the actuation fluid drain, and a second position in which the actuation fluid cavity is closed to the actuation fluid inlet but open to the actuation fluid drain. A needle valve member is positioned in the injector body and has a closing hydraulic surface exposed to fluid pressure in the needle control chamber. The needle valve member is moveable between an open position in which the nozzle outlet is open and a closed position in which the nozzle outlet is blocked. A needle control valve is attached to the injector body and moveable between an open position in which the needle control chamber is open to a source of high pressure fluid and an on position in which the needle control chamber is open to a source of low pressure fluid.

BEST MODE FOR CARRYING OUT THE INVENTION

Figure 1:
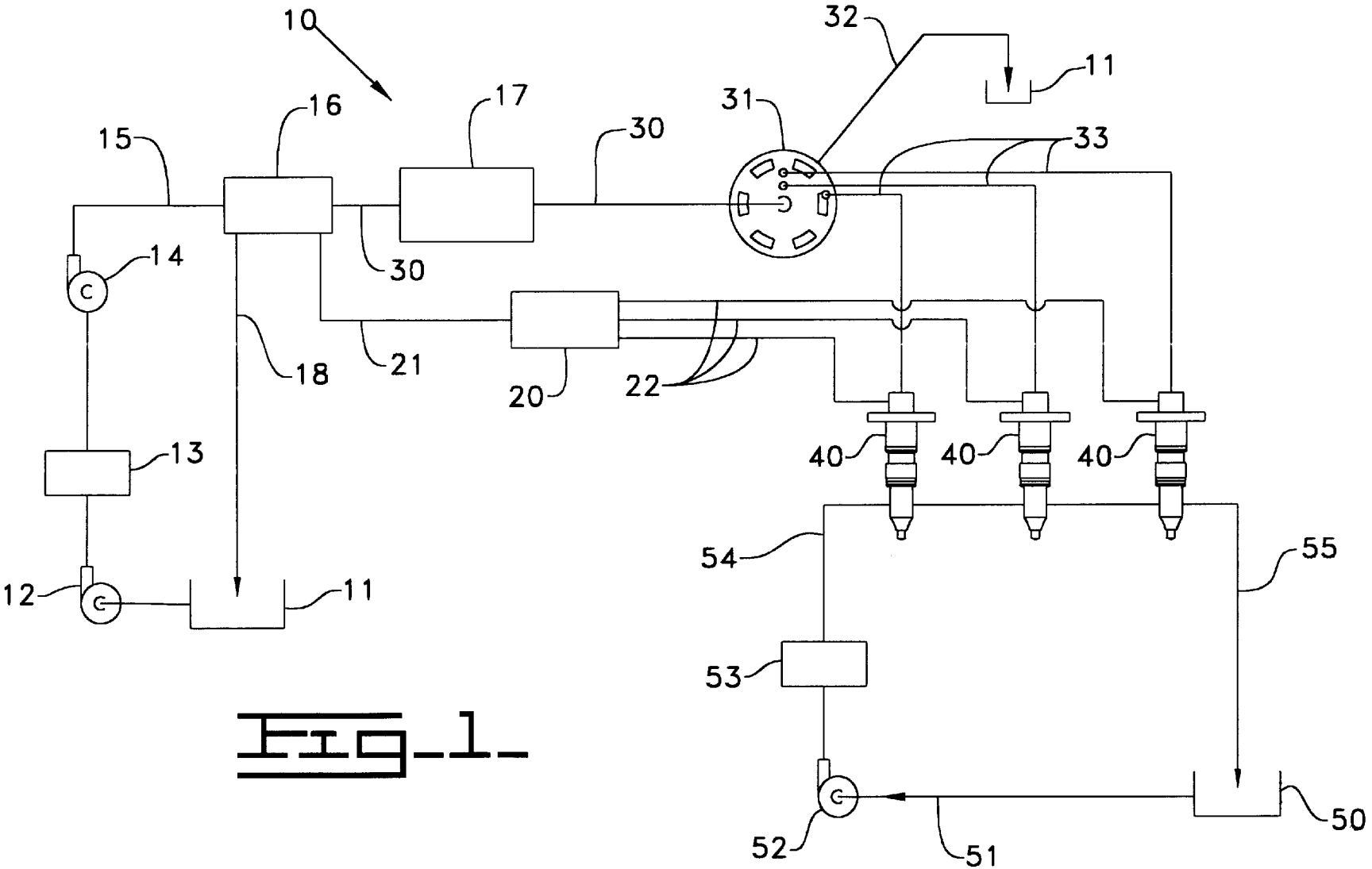
FIG. 1 is a schematic illustration of a fuel injection system according to one embodiment of the present invention.

Referring now to FIG. 1, a fuel injection system 10 adapted for use with the direct injection diesel type engine is illustrated. Fuel injection system 10 includes a plurality of hydraulically-actuated fuel injectors 40 that utilize oil originating from an oil sump 11 as a hydraulic actuation medium, and fuel originating from a fuel tank 50 as a fuel medium. When in operation, a low pressure transfer pump 12 draws oil from oil sump 11 and pushes the same through oil filter 13. After passing through filter 13, a high pressure oil pump 14 pumps the oil to a rail pressure control valve 16 via a high pressure oil supply passage 15.

An electronic control module 20 controls rail pressure control valve 16 via a communication line 21. Rail pressure control valve 16 is connected to a high pressure common rail 17 via an actuation fluid supply passage 30. Oil pressure in common rail 17 is maintained by controlling the amounts of oil from high pressure oil pump 14 that are either rerouted via return line 18 to oil sump 11 or directed to common rail 17 via actuation fluid supply passage 30. High pressure common rail 17 is connected to a cam driven oil distributor 31 via another portion of actuation fluid supply passage 30.

Cam driven oil distributor 31 sequentially connects actuation fluid supply/drain passage 33 of each injector to oil sump 11 via drain passage 32 and high pressure common rail 17 via actuation fluid supply passage 30. Cam driven oil distributor 31 essentially acts as a mechanically actuated valve that is attached to the actuation fluid supply passage and is moveable between an open position in which the actuation fluid supply passage is open to the individual injector and a closed position in which the actuation fluid supply passage is closed, but the drain is open. Cam driven oil distributor 31 is preferably powered directly from the engine drive shaft via a suitable camming or other linkage. An injection event takes place in the individual injector when oil distributor 31 opens actuation fluid supply passage 30 to actuation fluid supply/drain passage 33. The individual injector 40 resets itself between injection events when oil distributor 31 connects actuation fluid supply/drain passage 33 to drain passage 32.

A fuel pump 52 draws fuel from fuel tank 50 via a fuel supply passage 51. Pump 52 then pushes the fuel through fuel filter 53 and into circulation between injectors 40 via fuel supply passage 54. Any recirculated fuel is returned to fuel tank 50 via fuel return passage 55, for subsequent recirculation.

In addition to controlling the pressure in high pressure common rail 17, electronic control module 20 controls the opening and closing of the respective nozzle outlets of fuel injectors 40 via communication lines 22. Communication lines 22 generally refer to electronic control module commanding the supply of electric current to solenoids within respective injectors 40 for moving a needle control valve between an on position and an off position, as better described in relation to FIG. 2.

Figure 2:
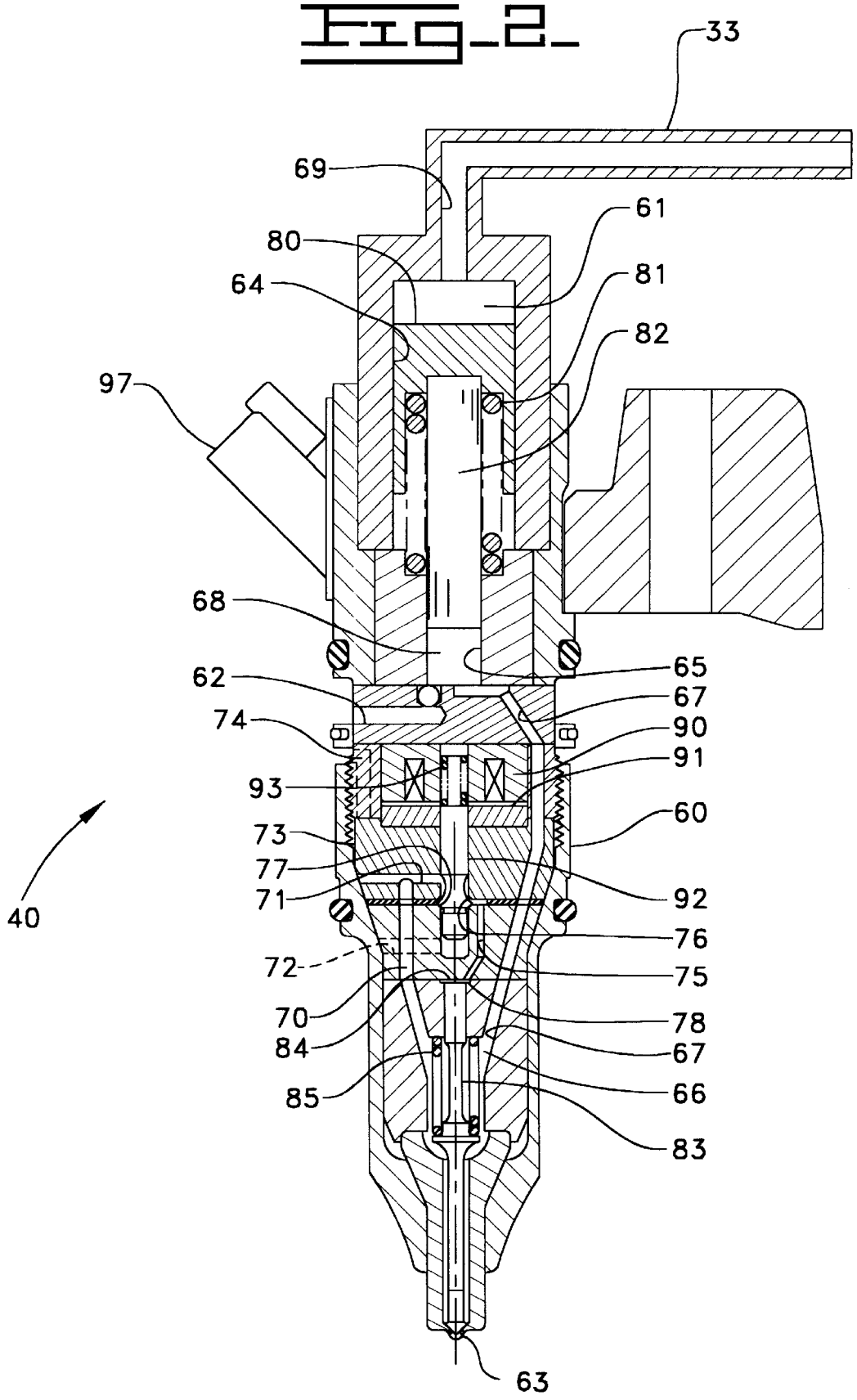
FIG. 2 is a sectioned side elevational view of a fuel injector according to another embodiment of the present invention.

Referring now to FIG. 2, each fuel injector 40 has an injector body 60 that defines an actuation fluid cavity 61, an actuation fluid inlet/drain 69, a needle control chamber 78, a fuel inlet 62, and a nozzle outlet 63. Actuation fluid supply/drain passage 33 is always open to actuation fluid cavity 61 via inlet/drain 69 in this embodiment. Injector body 60 also defines a piston bore 64, a plunger bore 65, a connection passage 67 and a nozzle chamber 66. An intensifier piston 80 reciprocates in piston bore 64 between an advanced position and a retracted position. A plunger 82, which moves with intensifier piston 80, reciprocates in plunger bore 65 between an advanced position and a retracted position. A portion of plunger bore 65 and plunger 82 is a fuel pressurization chamber 68 that is connected to nozzle chamber 66 via connection passage 67. Between injection events, a return spring 81 retracts piston 80 and plunger 82 to their respective retracted positions for a subsequent injection event. Fuel is drawn into fuel pressurization chamber 68 via fuel inlet 62 when plunger 82 is retracting under the action of return spring 81. A check valve prevents the back flow of fuel from fuel pressurization chamber 68 into fuel inlet 62 when plunger 82 is undergoing its downward stroke during an injection event.

A needle valve member 83, which is a portion of a direct control needle valve, is positioned in injector body 60 and includes a closing hydraulic surface 84 that is exposed to fluid pressure in needle control chamber 78. A biasing spring 85 normally biases needle valve member 83 to a lower position in which nozzle outlet 63 is blocked. When fuel pressure within nozzle chamber 66 is above a valve opening pressure-sufficient to overcome biasing spring 85, needle valve member 83 will lift to its open position to allow fuel to escape through nozzle outlet 63. However, this can only occur when needle control chamber 78 is open to a source of low pressure.

In order to control fuel injection, via the direct control needle valve a solenoid 90 is attached to injector body 60. Solenoid 90 includes an armature 91 that is attached to a needle control valve member 92. A biasing spring 93 normally biases armature 91 and needle control valve member 92 downward to a position in which a high pressure seat 76 is open but a low pressure seat 77 is closed. Needle control valve member 92 is preferably a poppet type valve member with a pair of conically shaped seating valve surfaces that seat against high and low pressure seats 76 and 77, respectively. When solenoid 90 is de-energized, needle control chamber 78 is in fluid communication with nozzle chamber 66 via a vertical connection passage 70, a horizontal high pressure passage 71, and control passage 75 past high pressure seat 76. Thus, when fuel injector 40 is undergoing its pumping stroke, fuel pressure in nozzle chamber 66 is high, and needle control chamber 78 can be considered to be open to a source of high pressure fluid when solenoid 90 is de-energized. Thus, the needle control valve is in an off position when solenoid 90 is de-energized and pressure in nozzle chamber 66 is high.

When solenoid 90 is energized, armature 91 and needle control valve member 92 are lifted to simultaneously close high pressure seat 76 and open low pressure seat 77. This creates a fluid connection between needle control chamber 78 and fuel recirculation opening 74 via control passage 75, past low pressure seat 77, into hidden fuel recirculation passage 72 and along annular fuel recirculation passage 73. Thus, when solenoid 90 is energized, needle control chamber 78 can be considered to be in an on position by being open to a source of low pressure fluid. When in this condition, needle valve member 83 behaves as a simple check valve such that it will only open when fuel pressure in nozzle chamber 66 is above a valve opening pressure sufficient to overcome biasing spring 85.

Figure 3:
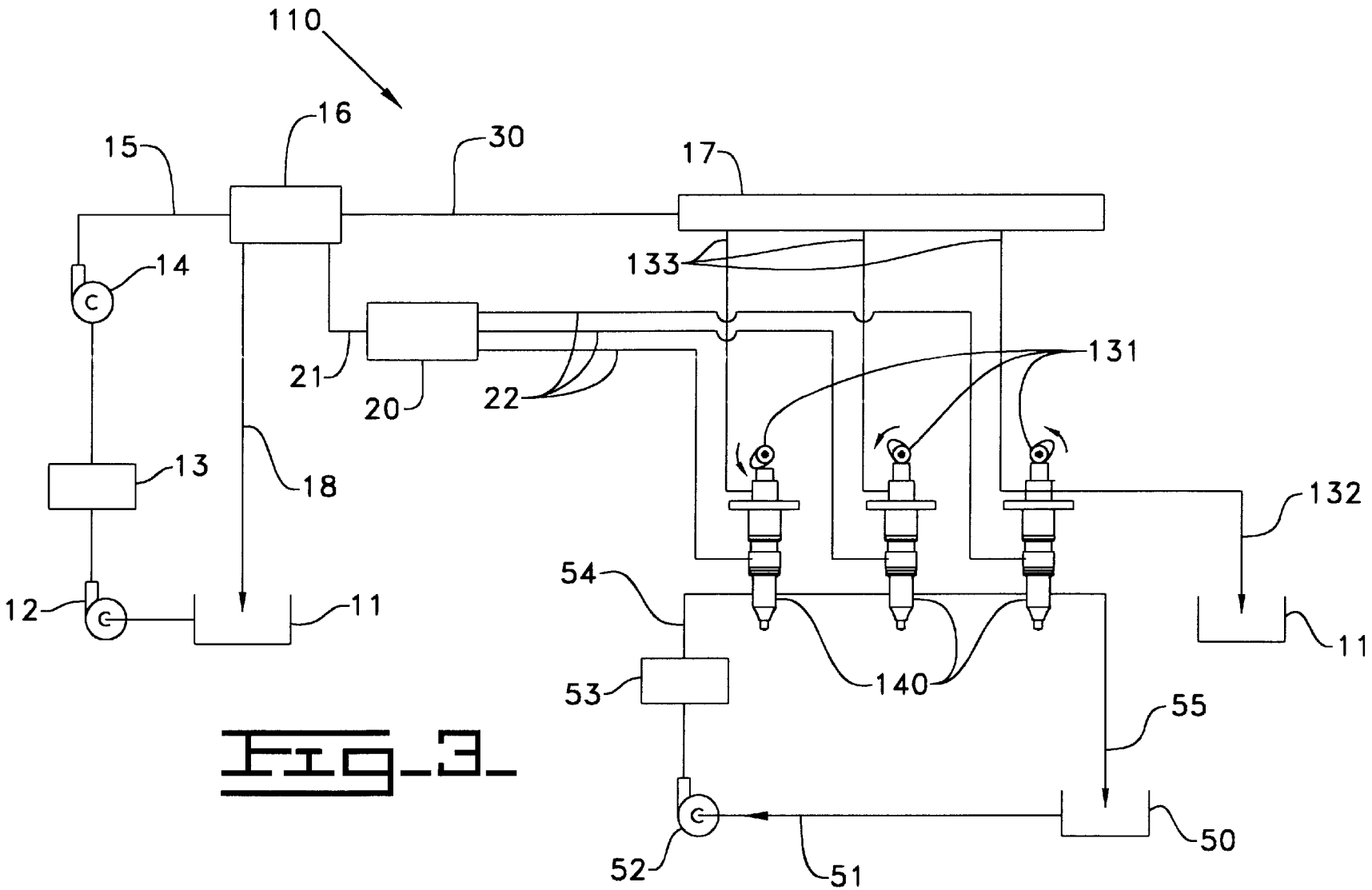
FIG. 3 is a schematic illustration of a fuel injection system according to still another embodiment of the present invention.
Figure 4:
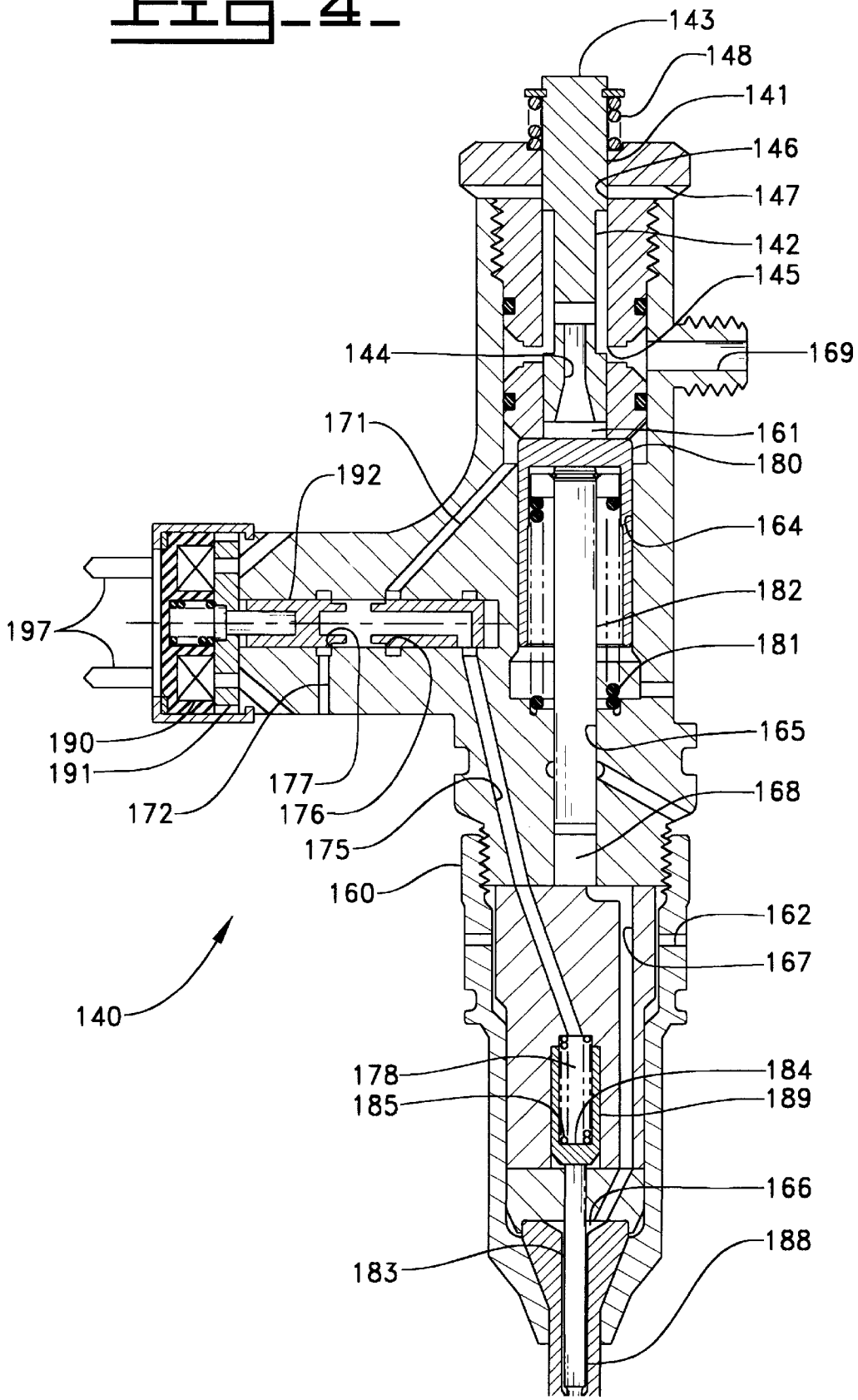
FIG. 4 is a sectioned side elevational view of a fuel injector according to another embodiment of the present invention.

Referring now to FIG. 3, a fuel injection system 110 according to another embodiment shares many features in common with a fuel injection system 10, and like numerals are utilized to identify the features that are shared in common. A description of these shared features will not be repeated. Referring in addition to FIG. 4, in this embodiment separate cams 131 act upon a separate cam actuated tappet member 143 of each fuel injector 140. The actuation fluid inlet 169 of each fuel injector 140 is connected to high pressure common rail 17 via an actuation fluid supply passage 133. Likewise, an actuation fluid drain 147 of each fuel injector is connected to oil sump 11 via an actuation fluid drain passage 132.

Fuel injector 140 differs from fuel injector 40 in several respects. First and probably foremost, this injector 140 uses pressurized oil to control the position of its needle valve member 183, whereas injector 40 of the previous embodiment utilizes pressurized fuel to control the opening and closing of its direct control needle valve, and hence the movement of its needle valve member 83. Injector 140 also differs from the previous embodiment in that no oil distributor is utilized outside of the injector body as in the previous embodiment. In this embodiment, a mechanically actuated valve 141 is moved between a first position and a second position via a cam actuated tappet member 143 as shown in FIG. 3. Thus, unlike injector 40 of the previous embodiment, fuel injector 140 has a separate actuation fluid inlet 169 and separate actuation fluid drain 147.

Fuel injector 140 includes an injector body 160 that defines an actuation fluid cavity 161, a fuel inlet 162, a nozzle outlet 163, a piston bore 164 and a plunger bore 165. An intensifier piston 180 reciprocates in piston bore 164 between a retracted position, as shown, and an advanced position. A plunger 182 moves with intensifier piston 180 and reciprocates in plunger bore 165 between a retracted position, as shown, and an advanced position. A portion of plunger bore 165 and plunger 182 define a fuel pressurization chamber 168 that is in fluid communication with a nozzle chamber 166 via a connection passage 167. Between injection events, a return spring 181 retracts piston 180 and plunger 182 to their respective retracted positions to reset the same for a subsequent injection event. During this retraction, fuel is drawn into fuel pressurization chamber 168 via a hidden passage and past a check valve that prevents back flow of fuel to the fuel inlet when the plunger is undergoing its downward stroke.

A needle valve member 188, which is a portion of a direct control needle valve, is positioned within injector body 160 and includes a needle portion 183 and an upper portion 189. Needle valve member 183 is moveable between an open position in which nozzle chamber 166 is open to nozzle outlet 163, and a closed position in which nozzle chamber 166 is blocked to nozzle outlet 163. A biasing spring 185, that is positioned in needle control chamber 178, normally biases needle valve member 183 to its closed position. The upper portion 189 of needle valve member 183 includes a closing hydraulic surface 184 that is exposed to fluid pressure in needle control chamber 178.

Mechanically actuated valve 141 includes cam actuated tappet member 143 that is exposed outside of injector body 160 and a spool valve member portion 142 that is positioned inside of the injector body. A return spring 148 normally biases mechanically actuated valve 141 to a position in which low pressure seat 146 is open and high pressure seat 145 is closed. When in this condition, actuation fluid cavity 161 is in fluid communication with actuation fluid drain 147 via hollow interior 144 of spool valve member portion 142. When mechanically actuated valve 141 is moved to a second position, as shown, by the act-on of a cam 131 acting on tappet member 143 low pressure seat 146 closes simultaneously with the opening of high pressure seat 145. When in this condition, actuation fluid cavity 161 is open to high pressure actuation fluid inlet 169 past high pressure seat 145 and through hollow interior 144.

A solenoid 190 is attached to injector body 160 and receives power via electrical connectors 197 in a conventional manner. Solenoid 190 includes an armature 191 that is attached to a control valve member 192 in a conventional manner. A biasing spring 195 normally biases armature 191 and control valve member 192 to the right to a position that opens high pressure seat 176 and closes low pressure seat 177. When in this condition, actuation fluid cavity 161 is in fluid communication with needle control chamber 178 via control passage 175 past high pressure seat 176 and through connection passage 171. Thus, when mechanically actuated valve 141 is in the position shown that opens high pressure actuation fluid inlet 169, and solenoid 190 is de-energized, needle control chamber 78 can be thought of as being in an off position by being open to a source of high pressure fluid, which in this case is the high pressure oil in actuation fluid cavity 161.

When solenoid 190 is energized, armature 191 and control valve member 192 are pulled to the left to simultaneously open low pressure seat 177 and close high pressure seat 176. When in this condition, needle control chamber 178 is open to control drain 172 via control passage 175 and past low pressure seat 177. Thus, when solenoid 190 is energized, needle control chamber 178 can be thought of as being in an on position by being open to a source of low pressure fluid.

INDUSTRIAL APPLICABILITY

Referring back to FIGS. 1 and 2, each fuel injector 40 is enabled for an injection event when oil distributor 31 opens actuation fluid supply/drain passage 33 to the high pressure common rail 17. This raises pressure within actuation fluid cavity 61 causing intensifier piston 80 and plunger 82 to move a slight distance downward until fuel pressure is raised in fuel pressurization chamber 68. However, needle valve member 83 remains in its closed position because the high pressure in fuel pressurization chamber 68 is communicated to needle control chamber 78 via connection passage 67, nozzle chamber 66, vertical connection passage 70, horizontal high pressure passage 77, past high pressure seat 76 and into control passage 75. Thus, plunger 82 becomes hydraulically locked with fuel at rated pressure ready for an injection event to begin. The injection of fuel commences when solenoid 90 is energized to close high pressure seat 76 and open low pressure seat 77. This releases the high pressure in needle control chamber 78, as discussed earlier, and allows needle valve member 83 to lift to an open position since the fuel in nozzle chamber 66 should now be above the valve opening pressure.

During the injection event, oil distributor 31 maintains the flow of high pressure actuation fluid into actuation fluid cavity 61. With nozzle outlet 63 open, plunger 82 is no longer hydraulically locked and it and piston 80 move downward under the action of hydraulic pressure in actuation fluid cavity 61. Each injection event is ended by de-energizing solenoid 90 so that control valve member 92 simultaneously closes low pressure seat 77 and opens high pressure seat 76. The fuel pressure in nozzle chamber 66 then is communicated to closing hydraulic surface 84 of needle valve member 83 causing the same to abruptly move downward to its closed position to close nozzle outlet 63 and end the injection event. When this occurs, plunger 82 again becomes hydraulically locked and stops its downward movement. A short time later, oil distributor 31 connects actuation fluid supply/drain passage 33 to drain passage 32 so that actuation fluid can be drained from actuation fluid cavity 61 allowing plunger 82 and piston 80 to retract under the action of return spring 82.

Referring now to FIGS. 3 and 4, fuel injector 140 is enabled when the cam 131 acting on tappet member 143 moves spool valve member 142 to close seat 146 and open seat 145. When this occurs, high pressure actuation fluid can flow into inlet 169 through hollow interior 144 and into actuation fluid cavity 161 to act upon the top surface of intensifier piston 180. At the same time, the high pressure now existing in actuation fluid cavity 161 is communicated to needle control chamber 178 to hold needle valve member 83 in its closed position to close nozzle outlet 163. With actuation fluid cavity 161 pressurized, piston 180 and plunger 182 move downward a slight distance but are hydraulically locked since nozzle outlet 163 is closed. However this slight downward movement brings fuel within fuel pressurization chamber 168 up to injection pressure. The injection event is initiated by energizing solenoid 190 to simultaneously close high pressure seat 176 and open low pressure seat 177. This relieves the high pressure in needle control chamber 178 acting upon closing hydraulic surface 184 to allow needle valve member 183 to lift to its open position to commence the spray of fuel out of nozzle outlet 163.

With the opening of nozzle outlet 163, plunger 82 begins its full downward stroke. The fuel injection event is ended by de-energizing solenoid 190 to simultaneously close low pressure seat 177 and open high pressure seat 176. With this movement of control valve member 192, the high pressure in actuation fluid cavity 161 is again communicated to needle control chamber 178. The high pressure acting on closing hydraulic surface 184 causes needle valve member 183 to abruptly close ending the injection event. A short time later, the camming surface on 131 allows spool valve member 142 to move upward to simultaneously close high pressure seat 145 and open low pressure seat 146. This allows the actuation fluid in actuation fluid cavity 161 to drain through drain passage 147, permitting plunger 182 and piston 180 to retract under the action of return spring 181.

The present invention finds potential application in virtually any fuel injection system, including gasoline and diesel type engines. The embodiment shown in FIGS. 3 and 4 is particularly suited as a retro fit fuel injection system to replace cam actuated fuel injectors with the cam enabled hydraulically actuated fuel injectors of the present invention. The present invention allows for significant control over fuel injection rate shaping, and accomplishes this task using a single two position solenoid. Thus, the fuel injection system of the present invention can retain the reliability of other single solenoid fuel injectors yet provide improved rate shaping performance through direct control of the needle valve member.

Those skilled in the art will appreciate the numerous modifications and alternative embodiments of the present invention will be apparent in view of the foregoing description. Accordingly, this description is to be construed as illustrative only, and is for the purpose of teaching those skilled in the art the best mode of carrying out the invention. The details of the structure may be varied substantially without departing from the spirit of the invention, the scope of which is defined in terms of the claims as set forth below.

What is claimed is:

1. A fuel injection system comprising:

a plurality of fuel injectors, each of said plurality of fuel injectors defining an actuation fluid cavity, a fuel inlet, at least one actuation fluid supply passage, at least one fuel fluid supply passage and a nozzle outlet, and including an electronically controlled direct control needle valve;

said at least one actuation fluid supply passage of each of said plurality of fuel injectors being fluidly connected to a source of high pressure actuation fluid;

said at least one fuel fluid supply passage of each of said plurality of fuel injectors being fluidly connected to a source of fuel fluid;

said source of high pressure actuation fluid being different from said source of fuel fluid;

said at least one actuation fluid supply passage of each of said plurality of fuel injectors being blocked from fluid communication with said at least one fuel fluid supply passage of each of said plurality of fuel injectors; and an exclusively mechanically actuated valve attached to each of said actuation fluid supply passages and movable between first position in which each of said at least one actuation fluid supply passages is open and a second position in which each of said at least one actuation fluid supply passages is closed.

2. The fuel injection system of claim 1 wherein each of said plurality of fuel injectors includes a needle valve member having a closing hydraulic surface exposed to fluid pressure in a needle control chamber, and said needle valve member is movable between a first position in which said nozzle outlet is open and a second position in which said nozzle outlet is locked; and each of said plurality of fuel injectors further includes a needle control valve movable between a first position in which said needle control chamber is open to a source of high pressure fluid and a second position in which said needle control chamber is open to a source of low pressure fluid.

3. The fuel injection system of claim 2 wherein each of said plurality of fuel injectors includes a relatively low pressure actuation fluid drain;

said source of high pressure fluid is said source of relatively high pressure actuation fluid; and said source of low pressure fluid is said relatively low pressure actuation fluid drain.

4. The fuel injection system of claim 3 wherein said mechanically actuated valve is a cam driven fluid distributor positioned outside each of said plurality of fuel injectors.

5. The fuel injection system of claim 3 wherein said mechanically actuated valve includes a cam actuated valve member positioned at least partially inside each of said plurality of fuel injectors.

6. The fuel injection system of claim 2 wherein each of said plurality of fuel injectors includes a fuel pressurization chamber and a fuel recirculation passage;

said source of high pressure fluid is said fuel pressurization chamber; and said source of low pressure fluid is said fuel recirculation passage.

7. The fuel injection system of claim 6 wherein said mechanically actuated valve is a cam driven fluid distributor positioned outside each of said plurality of fuel injectors.

8. The fuel injection system of claim 6 wherein said mechanically actuated valve includes a cam actuated valve member positioned at least partially inside each of said plurality of fuel injectors.

9. A mechanically enabled electronically controlled fuel injector comprising:

an injector body defining an actuation fluid cavity, a needle control chamber, a fuel inlet, nozzle outlet, an actuation fluid inlet, at least one actuation fluid passage and at least one fuel fluid passage;

an actuation fluid supply passage connecting said actuation fluid inlet to a source of actuation fluid;

a fuel fluid supply passage connecting said fuel inlet to a source of fuel fluid;

said at least one actuation fluid passage, said actuation fluid supply passage, and said actuation fluid inlet being closed from fluid communication with said at least one fuel fluid passage, said fuel fluid supply passage and said fuel inlet;

an exclusively mechanically actuated valve attached to said injector body and being movable between a first position in which said actuation fluid inlet is open and a second position in which said actuation fluid inlet is closed;

a direct control needle valve that includes a needle valve member positioned in said injector body and having a closing hydraulic surface exposed to fluid pressure in said needle control chamber; and an electronically controlled needle control valve member in said injector body movable between a first position in which said needle control chamber is exposed to a source of high pressure fluid and a second position in which said needle control chamber is exposed to a source of low pressure fluid.

10. The mechanically enabled electronically controlled fuel injector of claim 9 further comprising a relatively low pressure actuation fluid drain;

said source of high pressure fluid being said source of relatively high pressure actuation fluid; and said source of low pressure fluid being said relatively low pressure actuation fluid drain.

11. The mechanically enabled electronically controlled fuel injector of claim 10 wherein said mechanically actuated valve is a cam driven fluid distributor positioned outside said fuel injector.

12. The mechanically enabled electronically controlled fuel injector of claim 10 wherein said mechanically actuated valve includes a cam actuated valve member positioned at least partially inside said fuel injector.

13. The mechanically enabled electronically controlled fuel injector of claim 9 further comprising a fuel pressurization chamber and a fuel recirculation passage;

said source of high pressure fluid being said fuel pressurization chamber; and said source of low pressure fluid being said fuel recirculation passage.

14. The mechanically enabled electronically controlled fuel injector of claim 13 wherein said mechanically actuated valve is a cam driven fluid distributor positioned outside said fuel injector.

15. The mechanically enabled electronically controlled fuel injector of claim 12 wherein said mechanically actuated valve includes a cam actuated valve member positioned at least partially inside said fuel injector.

16. A method of fuel injection comprising the steps of:

providing a mechanically enabled electronically controlled fuel injector which includes at least one actuation fluid passage blocked from fluid communication with at least one fuel fluid passage, a needle control chamber, a nozzle outlet, a direct control needle valve, a moveable needle control valve member and an exclusively mechanically actuated valve attached to said actuation fluid passage movable between an on position in which said at least one actuation fluid passage is open and an off position in which said at least one actuation fluid passage is closed;

enabling said fuel injector for an injection event at least in part by mechanically moving said mechanically actuated valve to said first position fluidly connecting said fuel injector to a source of high pressure actuation fluid;

electronically moving said needle control valve member to an on position in which said needle control chamber is fluidly connected to a source of low pressure fluid;

electronically moving said needle control valve member to an off position in which said needle control chamber is fluidly connected to a source of high pressure fluid;

mechanically disabling said fuel injector at least in part by mechanically moving said mechanically actuated valve to said second position connecting said at least one actuation fluid passage to a low pressure actuation fluid reservoir;

evacuating an amount of actuation fluid toward said low pressure actuation fluid reservoir; and refilling said fuel injector with an amount of fuel from a source of fuel, which is different from said actuation fluid.

17. The method of claim 16 wherein said step of electronically moving said needle control valve member to said first position occurs prior to said step of enabling said fuel injector for an injection event.

18. The method of claim 16 wherein said step of electronically moving said needle control valve to said first position occurs at least twice before said step of mechanically disabling said fuel injector.

19. The method of claim 16 wherein said fuel injector includes a spring bias which defines a valve opening pressure; and said step of electronically moving said needle control valve to said second position occurs after an amount of fuel pressure reaches said valve opening pressure.

20. The method of claim 16 wherein said mechanically actuated valve includes a cam driven valve member at least partially positioned in said fuel injector; and said enabling and disabling steps are accomplished at least partially by rotating said cam.

* * * * *